US007191750B2

(12) United States Patent
Daly et al.

(10) Patent No.: US 7,191,750 B2
(45) Date of Patent: Mar. 20, 2007

(54) LASER WELDED MANIFOLD

(75) Inventors: Paul Daly, Troy, MI (US); Bobbye Baylis, Harrow (CA); Bruce Harvey, Shelby Township, MI (US); Dennis Houle, Chatham (CA); Gowda Venugopala, Windsor (CA); James Vanderveen, Blenheim (CA); Stephen Bloomer, Lambeth (CA); Ki-Ho Lee, Windsor (CA)

(73) Assignee: Siemens Canada Limited, Chatham (CA)

( * ) Notice: Subject to any disclaimer, the term of this patent is extended or adjusted under 35 U.S.C. 154(b) by 43 days.

(21) Appl. No.: 11/101,079

(22) Filed: Apr. 6, 2005

(65) Prior Publication Data

US 2005/0217627 A1 Oct. 6, 2005

Related U.S. Application Data

(60) Provisional application No. 60/602,356, filed on Aug. 18, 2004, provisional application No. 60/566,560, filed on Apr. 29, 2004, provisional application No. 60/559,984, filed on Apr. 6, 2004.

(51) Int. Cl.
*F02M 35/10* (2006.01)

(52) U.S. Cl. ..... 123/184.61; 123/184.21

(58) Field of Classification Search ..... 123/184.21, 123/184.47, 184.61; 29/890.08; 264/250, 264/482
See application file for complete search history.

(56) References Cited

U.S. PATENT DOCUMENTS 6,199,530 B1 * 3/2001 Brassell et al. ..... 123/184.34

FOREIGN PATENT DOCUMENTS

EP 1174247 A1 * 1/2002

* cited by examiner

*Primary Examiner*—Stephen K. Cronin
*Assistant Examiner*—Hyder Ali

(57) ABSTRACT

An intake manifold assembly (100) includes an inner shell (12) that is inserted into an outer shell (14), and a cover (25) that seals the open end (38) of the outer shell (14). The inner shell (12) includes dividers (16) that form air passages (18). A laser device (40) is traversed along the outer surface of the outer shell (14) along a path (44) corresponds with the inner shell (12) to form a laser weld joint (45). The intake manifold assembly (10) of this invention includes features and methods of assembly that improve the laser weld joints utilized to assemble the plastic intake manifold assembly (10). Both design details and clamping detail are described, every known configuration of U type manifolds can be made by this technique. The technique provides high value and low cost. High reliability is a well known feature of laser welding.

26 Claims, 9 Drawing Sheets

LASER WELDED MANIFOLD

The application claims priority to U.S. Provisional Application Ser. Nos. 60/559,984 filed on Apr. 6, 2004, 60/566,560 filed on Apr. 29, 2004, and 60/602,356 filed on Aug. 18, 2004.

BACKGROUND OF THE INVENTION

This invention is generally related to an intake manifold and a method of assembling an intake manifold. More particularly, this invention relates to an intake manifold fabricated from an inner shell inserted and welded within an outer shell utilizing a laser welding process.

Plastic intake manifolds have been developed for use in motor vehicles that provide reduced weight and cost. A plastic intake manifold is typically constructed from a plurality of parts that are molded separately and then joined to one another. Various methods are known for joining plastic parts including vibration welding. Joint configurations for these plastic parts typically include a complicated cross-section for providing sufficient melt down material as well as features for trapping flash. Such joint geometries contribute substantially to the cost of fabricating an intake manifold.

Further, vibrational welding methods lead to the design of plastic manifolds that are designed to include a series of horizontal or vertical slices. Horizontal and vertical slices result in a plurality of parts that must be joined. Each of the many parts requires a separate molding tool and assembly station that complicates assembly and increases overall cost. Additionally, at least some of the joints are not accessible for reprocessing once the completed part is assembled making impractical repair of a defective intake manifold assembly.

Laser welding has been used to join plastic parts with success. Laser welding of plastic is accomplished by directing a laser through a laser translucent material onto a laser absorbent material. Laser Transmission Contour Welding is known for use with large asymmetrical parts. Kinematics of robots has advanced to permit following a complex contour such as is typical of an intake manifold assembly. However, typically laser welding requires aligned joints and contact between surfaces to be jointed. Disadvantageously, plastic parts are not typically fabricated to the tolerances required to provide desired alignment between joint contact surfaces. Further, part inconsistencies and imperfections can affect joint alignment causing undesirable weld performance.

Accordingly, it is desirable to design a plastic intake manifold with assembly and joint features that improve and simplify joint structure for improved laser welded joints.

SUMMARY OF THE INVENTION

This invention is a plastic intake manifold assembly including an inner shell and an outer shell including an improved joint interface for a laser transmission weld.

An example intake manifold assembly of this invention includes an inner shell that is inserted into an outer shell, and a cover that seals the open end of the outer shell. The inner shell includes dividers that form air passages. The dividers are J-shaped channels that include the desired configuration of the air passages. A laser device is traversed along the outer surface of the outer shell along a predetermined path that corresponds with the position of the inner shell such that a desired laser weld joint is formed.

In weld joint locations, the thickness of the outer shell is of a lesser thickness than non-weld joint areas. The thinner sections allow for more laser energy to penetrate to the inner shell without increasing the energy output from the laser device or modifying the material composition of the outer shell. The increased energy provided at the inner shell increases the amount of molten plastic produced, that in turn increases the size of a gap that can be bridged and welded.

The inner shell includes edge surfaces that are placed in contact with the inner surface of the cavity. The edge surface includes pads disposed in areas where it is desired to increase the strength of the laser weld joint. The pads provide a larger surface area for the laser weld joint in the discrete localized area. During the welding process the laser device will retrace the desired weld path that corresponds to the location of the pads such that an increased weld area is provided in the areas defined by the pads.

The inner shell is clamped to the outer shell by a clamping device that cooperates with a clamping ridge fabricated into the outer shell and a clamping pad provided on the inner shell. The clamping device is an elongated bladed member inserted between the inner shell and the outer shell. Rotation of the clamping device forces the inner shell outward and downward against the inner surface of the outer shell. Rotation of the clamping device pushes the inner shell tightly against the outer shell to deform the inner shell in a manner that reduces or substantially eliminates gaps therebetween.

The cover includes an axial joint, a radial joint portion and a transitional joint between the axial joint and the radial joint. Between the axial joint and the radial joint is the transitional joint were the interface between the cover and the outer shell curves from the flange to the edge interface. The cover is clamped and pressed onto the outer shell. The different joint configurations reduce the effects on fit caused by the generous tolerances required by the injection molding process.

The example intake manifolds of this invention provide a substantial reduction in the number of manufacturing steps, along with a substantial simplification in the joint between manifold parts. Further, the features provided with the methods and configurations of the intake manifold improve laser weld joint performance and application. Accordingly, the methods and intake manifold feature of this invention improve and simplify assembly to provide improved laser welded joint structures.

These and other features of the present invention can be best understood from the following specification and drawings, the following of which is a brief description.

DETAILED DESCRIPTION OF THE PREFERRED EMBODIMENT

Figure 1:
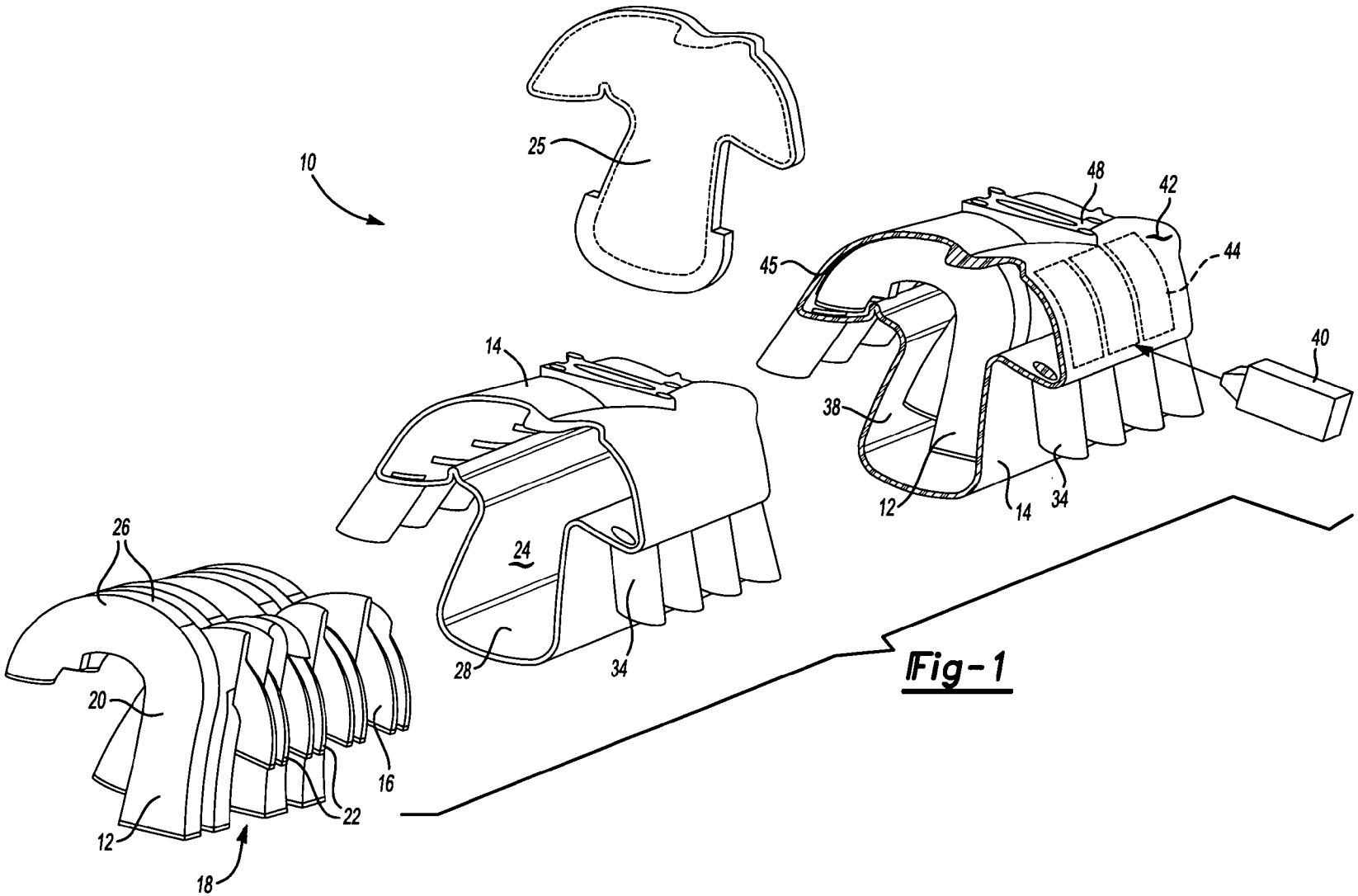
FIG. 1 is a schematic view illustrating assembly of an example intake manifold according to this invention.

Referring to FIG. 1, an example intake manifold assembly 10 is shown and includes an inner shell 12 that is inserted into an outer shell 14, and a cover 25 that seals the open end 38 of the outer shell 14. The inner shell 12 includes dividers 16 that form air passages 18 through the intake manifold assembly 10. The dividers 16 are J-shaped channels that include the desired configuration of the air passages. Further, the dividers 16 include enclosed portions 20 and walled portions 22. The enclosed portions 20 provide a tube that extends into a cavity 24 of the outer shell 14. The walled portions 22 include two sides that correspond to an inner surface 28 of the cavity 24 to form the remainder of an air passage 32 into intake runners 34 within the outer shell 14.

The outer shell 14 defines the cavity 24 and runners 34 that extend and connect with an engine (not shown) to communicate air to each engine cylinder. The intake manifold assembly 10 is assembled by inserting the inner shell 12 into the outer shell 14 as is shown. The inner shell 12 is then clamped such that surfaces of the inner shell 12 that will form a weld joint with the outer shell 14 are in substantial contact with the inner surface 28 of the outer shell 14.

A laser device 40 is traversed along the outer surface 42 of the outer shell 14 along a predetermined path 44. The predetermined path 44 corresponds with the position of the inner shell 12 such that a desired laser weld joint is formed. The predetermined path 44 is illustrated as a simple rectangular path; however, the path of the laser device 40 can be of any shape required to provide the desired joints for joining the inner shell 12 to the outer shell 14.

Figure 2:
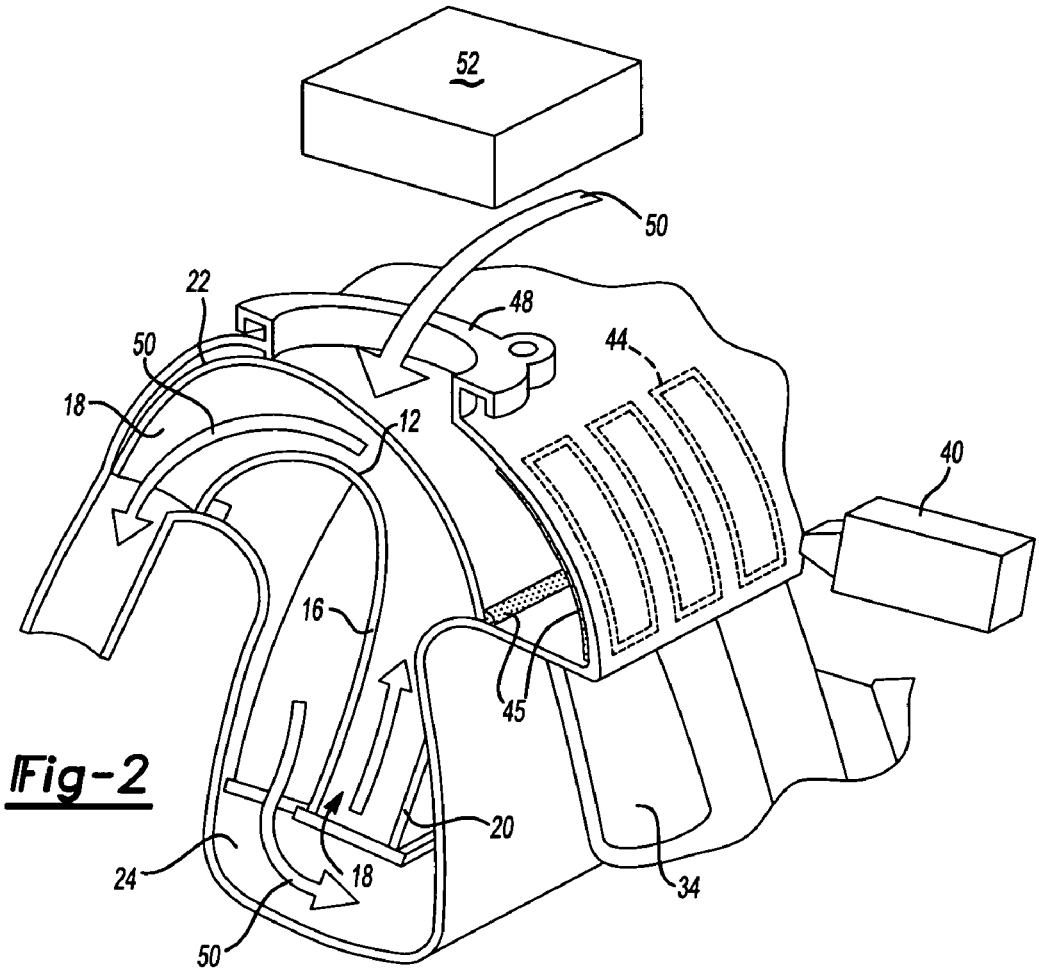
FIG. 2 is a perspective view of an example intake manifold according to this invention.

Referring to FIG. 2, laser weld joints 45 are formed by applying a directed beam of laser energy through the outer shell 14 and onto the inner shell 12. The outer shell 14 is formed from a laser transmissive or transparent material that allows a portion of laser energy to penetrate through the outer shell 14. Typical laser transparent materials allow between 10% and 30% of the laser energy to penetrate through to the inner surface of the outer shell 14. The specific amount of laser energy that penetrates through to the inner shell 12 is dependent on the material composition of the outer shell 14, the thickness of the outer shell 14 and the power of the laser device 40.

Laser energy that penetrates the outer shell 14 impacts the inner shell 12. The inner shell 12 is composed of a laser absorbent material such that laser energy is absorbed and transformed into heat energy that in turn generates a region of molten plastic material. The molten plastic material transfers a portion of heat to the outer shell 14. The portion of the outer shell 14 adjacent the molten material of the inner shell 12 melts and intermixes with the molten material of the inner shell 12. The molten material will then cool and form the desired bond and laser welded joint 45.

The power and type of laser device 40 used to perform the laser weld maybe of any known configuration. Further, it is within the contemplation of this invention to utilize any known laser device for generating and performing the laser weld operation.

Once the laser weld joint 45 is complete, the intake manifold assembly 10 is substantially complete except for assembly of external devices such as a throttle body, sensors and other hardware supporting operation.

The assembled intake manifold assembly 10 is shown as a cross-section through the mount 48. Airflow 50 through the mount 48 enters the cavity 24. The cavity 24 is in communication with each of the air passages formed by the dividers 16. In this example, the dividers 16 include the enclosed portion 20 that extend into the cavity 24. Airflow 50 entering the enclosed portion 20 flows through the air passage to the walled portion 22. The walled portion 22 cooperates with the inner surface 28 to define the remainder of the air passage 18.

Formation of a laser weld joint requires that the inner shell 12 and the outer shell 14 be in substantial contact at the weld joint interface. Gaps between the inner shell 12 and the outer shell 14 can cause undesirable weld properties. The size of the gap that is allowable is related to the amount of laser energy that is transmitted to the joint interface. The greater the energy that penetrates the outer shell 14, the larger the gap that can be accommodated by the laser weld joint. Accordingly, the inventive process described in this disclosure includes methods and configurations to optimize laser energy and minimize gaps between the inner shell 12 and the outer shell 14 at weld joint interfaces.

Figure 3:
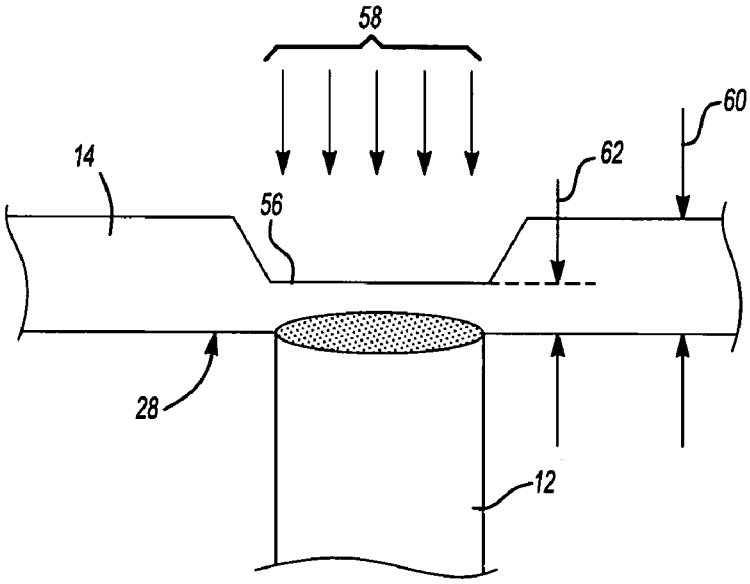
FIG. 3 is a cross-sectional view of a joint between an inner shell and an outer shell.

Referring to FIG. 3, the amount of laser energy available is related to the laser energy power and the thickness of the laser transmissive or transparent material. The thicker the materials the less laser energy that will be available for a welding operation. However, the outer shell 14 must include a thickness that is capable of enduring durability and pressure testing. Accordingly a minimum thickness is required in all areas of the outer shell 14.

In weld joint locations, the thickness of the outer shell 14 is combined with the thickness of the inner shell 12 joined in that specific area. The outer shell 14 can therefore be a lesser thickness in weld areas 56. The outer shell 14 includes a first thickness 60 and a second thickness 62 less than the first thickness 60. The second thickness 62 is aligned with the portion of the inner shell 12 along the predetermined weld path 44. As an example, the first thickness is approximately 4 mm and the second thickness is approximately 2 mm. The thinner section provided by the second thickness allows for more laser energy 58 to penetrate to the inner shell 12 without increasing the energy output from the laser device 40 or modifying the material composition of the outer shell 14. The increased energy provided at the inner shell 12 increases the amount of molten plastic produced, that in turn increases the size of any the gap that can be bridged and welded.

Another method for increasing the amount of molten plastic at the weld interface is to fabricate the inner shell 12 with a reduced amount of glass reinforcement material. Injection molded plastic parts include a portion of glass fiber for reinforcing and strengthening the material. The inner shell 12 is not a load bearing part and is not subject to pressure requirements as the outer shell 14 is; accordingly, the inner shell 12 may be of a reduced strength. Therefore the amount of glass reinforcement is reduced to approximately 15%. Typical glass reinforcement content is approximately 30%. The reduced amount of glass reinforcement results in an increase in percent resin content. The resin is the part of the plastic material that forms the molten plastic pool in the presence of heat from the laser device 40. The increased amount of resin material results in an increase in the amount of molten material responsive to the same amount of laser energy. The increased size of the molten plastic pool results in an increased gap size that may be comfortably accommodated and still provide the desired laser weld joint.

Another method according to this invention for increasing the size of the molten plastic pool is to include a foaming agent in one of the outer shell 14 or inner shell 12. The foaming agent increases and expands the molten plastic pool by releasing gas from the material upon exposure to heat. The released gas provides an expansion or inflation of the molten plastic material. The foaming agent may comprise any agent that provides an out-gassing upon exposure to heat energy. As appreciated any foaming agent as is known in the art is within the contemplation of this invention.

Figure 4:
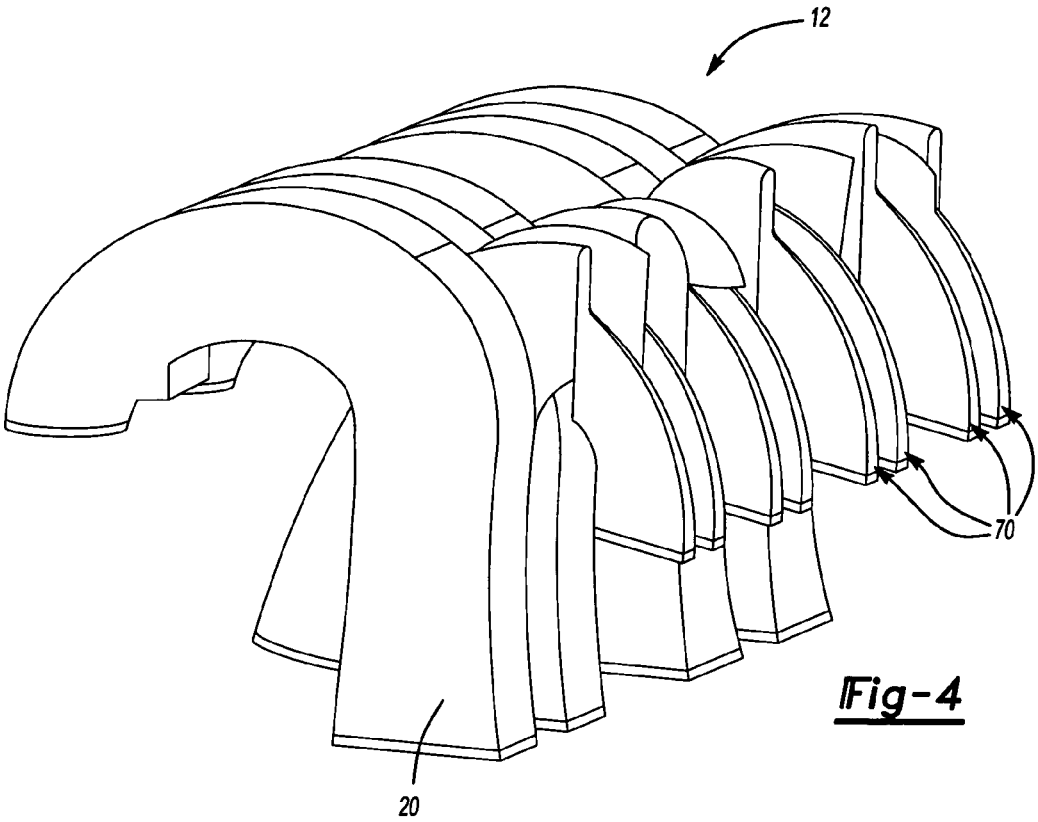
FIG. 4 is a perspective view of an inner shell.
Figure 5:
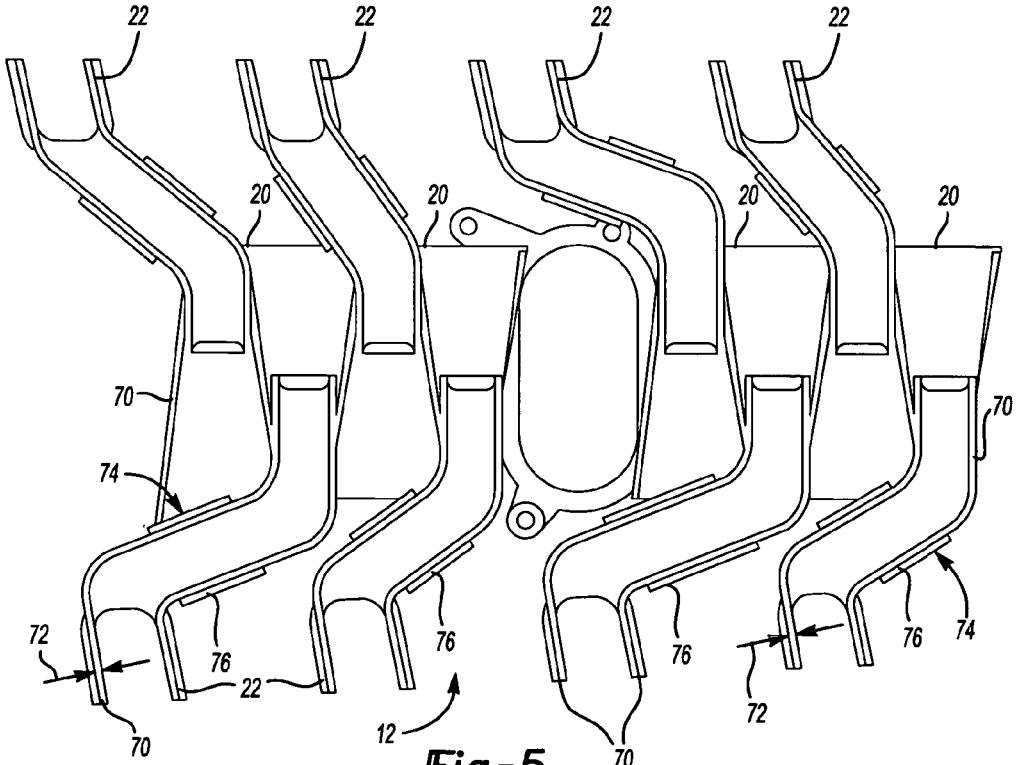
FIG. 5 is a top view of the inner shell.

Referring to FIGS. 4 and 5, the inner shell 12 includes edge surfaces 70 that are placed in contact with the inner surface 28 of the cavity 24. The edge surfaces 70 include a first width 72. The first width 72 provides for tolerances in location during the assembly process. The laser device 40 aims the laser beam through the outer shell 14 such that the penetrating portion of the beam will impact on the inner shell 12. The edge surfaces 70 provide the weld joint interface with the outer shell 14. The first width 72 provides the desired tolerance and a desired contact area for the laser weld joint. The contact area provides the desired and resulting strength of the completed laser weld joint.

The edge surface 70 include pads 76 disposed in area where it is desired to increase the strength of the laser weld joint. The pads 76 include a second width 74 that is greater than the first width 72 to provide a larger surface area for the laser weld joint in the discrete localized area. During the welding process the laser device 40 will retrace the desired weld path that corresponds to the location of the pads 76 such that an increased weld area is provided in the discrete localized areas defined by the pads 76.

Increasing the weld area and the amount of molten plastic material at a weld interface are ways to increase the amount of gap that can be accommodated by a laser welded joint. As appreciated, it is desirable to eliminate gaps at a weld interface. Accordingly, this invention includes a method of clamping the inner shell 12 to the outer shell 14. Clamping is complicated because the inner shell 12 and outer shell 14 are substantially irregularly shaped, and because any clamping must be done in such a way so as to not obstruct access of the laser device 40.

Figure 6:
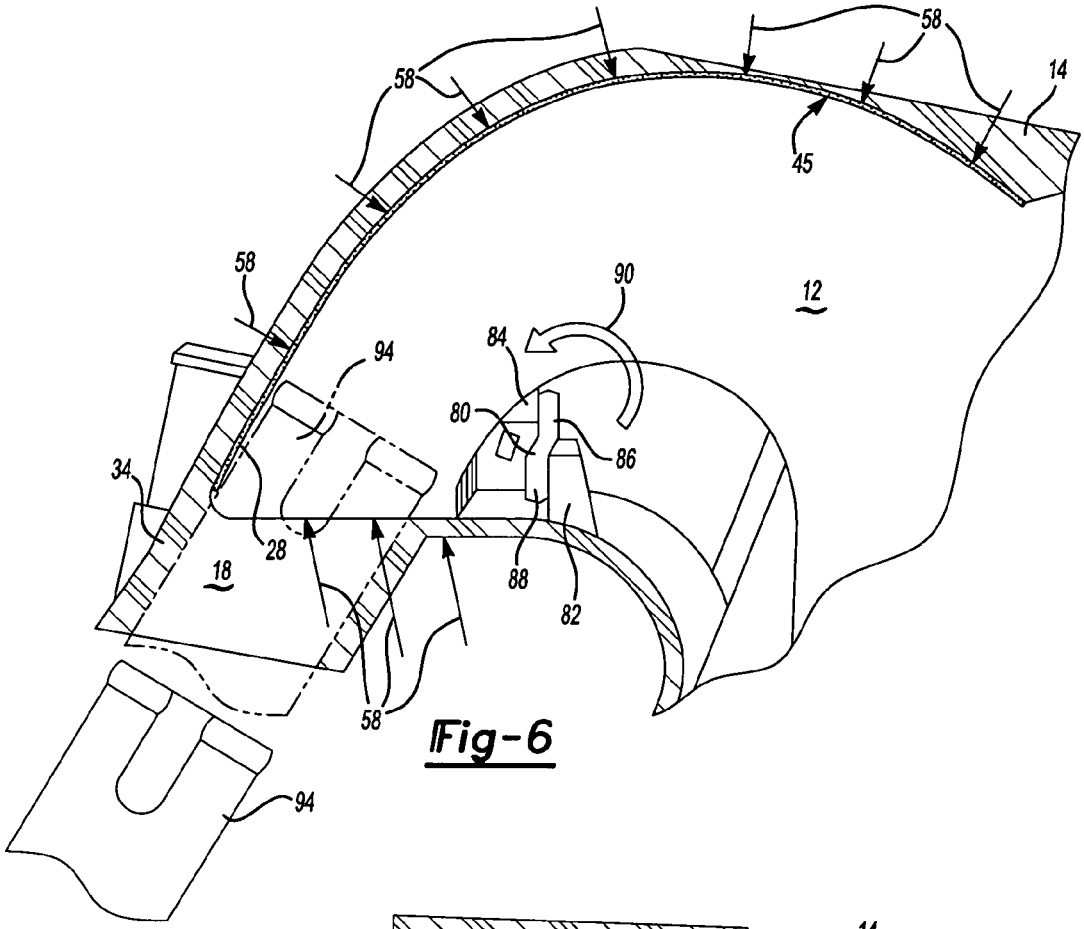
FIG. 6 is a partial cross-sectional view of an example device for clamping and aligning the inner shell with the outer shell according to this invention.

Referring to FIG. 6, an example clamping device 80 is shown that corresponds to a clamping ridge 82 fabricated into the outer shell 14 and a clamping pad 84 provided in the inner shell 12. The clamping device 80 is an elongated bladed member inserted between the inner shell 12 and the outer shell 14. The clamping device 80 includes a first tab 86 that contacts the clamping pad 84 and a second tab 88 in contact with the clamping rib 82. The clamping device 80 rotates in a direction indicated at 90 to force the inner shell 12 outward and downward against the inner surface 28 of the outer shell 14. Rotation of the clamping device 80 pushes the inner shell 12 tightly against the outer shell 14 to deform the inner shell 12 in a manner that reduces or substantially eliminates gaps therebetween.

Prior to application of rotary force by the clamping device 80, an alignment tool 94 is inserted through the outer shell 14 and received with the inner shell 12 (indicated by dashed outline within the air passage 18). The alignment tool 94 assures alignment of the walled portions 22 with the air passages 34 such that there is no overlapping of the inner shell 12 over opening for the air passages 34. The alignment tool 94 includes a cutout center section 96 to accommodate initial misalignment of the inner shell 12. As appreciated although a single alignment tool 94 is shown, several alignment tools 94 may be used to accommodate multiple air passages and align each air passages with the inner shell 12. Once the inner shell 12 is aligned as desired the clamping device 80 is rotated to force abutment of the inner shell 12 with the outer shell 14. The laser device 40 traverses along the desired weld path and directs laser energy 58 through the outer shell 14 to generate the desired laser weld joint 45.

Figure 7:
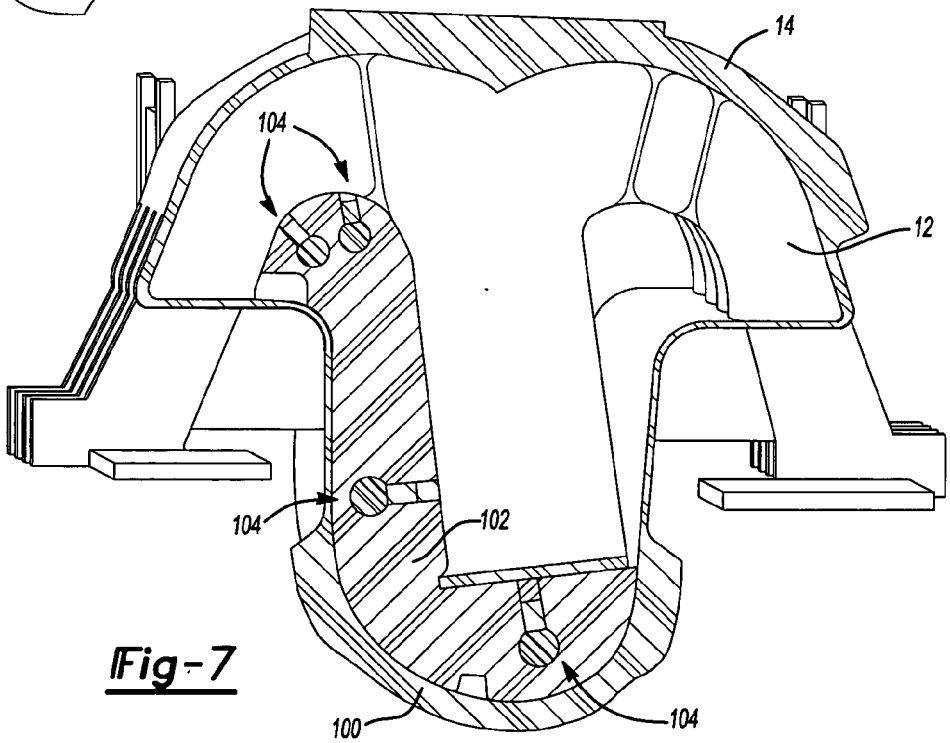
FIG. 7 is another partial cross-sectional view of another device for clamping and aligning the inner shell with the outer shell according to this invention.

Referring to FIG. 7 another clamping device 100 is shown and includes a housing 102 that is inserted along with the inner shell 12 into the outer shell 14 The housing 102 supports a plurality of pneumatically operated pistons 104 that contact and push the inner shell 12 against the outer shell 14. Actuation of the pistons 104 pushes the housing 102 against the outer shell 14 and the inner shell 12 upward and outward against the inner surface 28 of the cavity 24. The pistons 104 are located to provide increased pressure at desired points to eliminate gaps and provide a tight fit for the generation of the laser weld joint. As appreciated, the specific location of the pistons 104 are determined for the specific application to provide the desired pressure and force required to drive the inner shell 12 upward and outward against the inner surface 28 of the outer shell 14. The clamping device 100 may temporarily deform portions of the inner shell 12 in order to eliminate gaps in the desired laser weld joint area.

Figure 8:
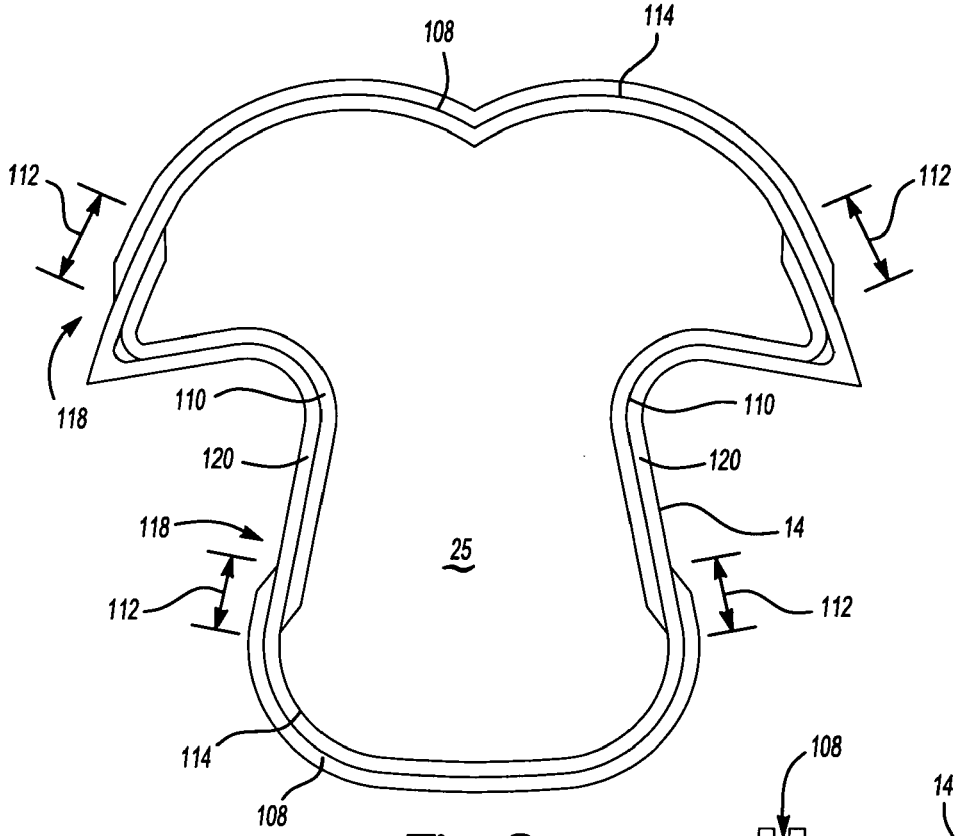
FIG. 8 is a plan view of a cover attached to the outer shell.
Figure 9:
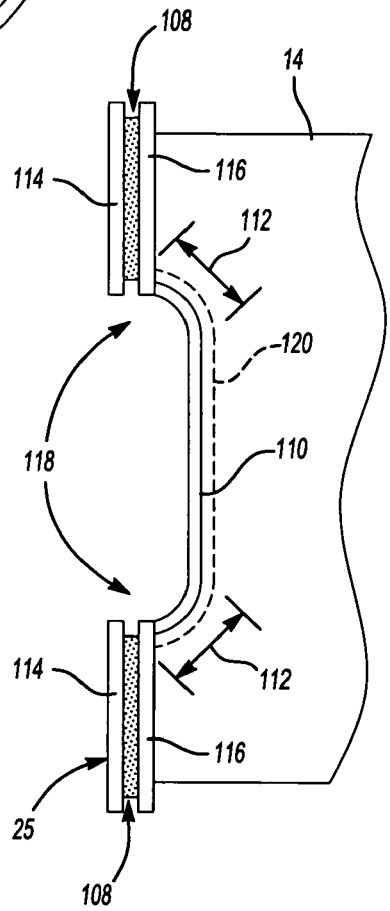
FIG. 9 is a side view of the cover attached to the outer shell.

Referring to FIGS. 8 and 9, the cover 25 is welded over the open end 38 of the outer shell 14 to seal the cavity 24 once the inner shell 12 has been attached (FIG. 1). Open end 38 in the outer shell 14 is irregularly shaped and therefore presents mating assembly problems with the cover 25. Further, as both the cover 25 and the outer shell 14 are formed from injection molded plastic, tolerances are generally generous and therefore require an innovative method and design for assuring a desired fit and seal. Any, single type of joint such as an axial or radially oriented joint that extends about the entire interface between the cover 25 and outer shell 14 is problematic due to the tolerances provided each plastic part.

Figure 10:
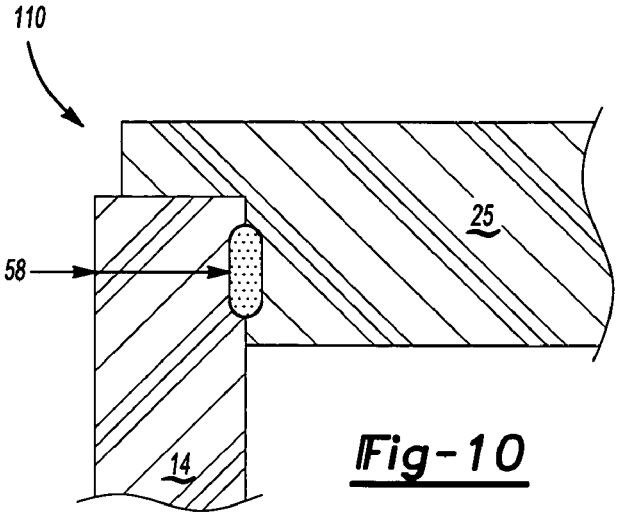
FIG. 10 is an enlarged cross-sectional view of a radial joint between the cover and the outer shell.
Figure 11:
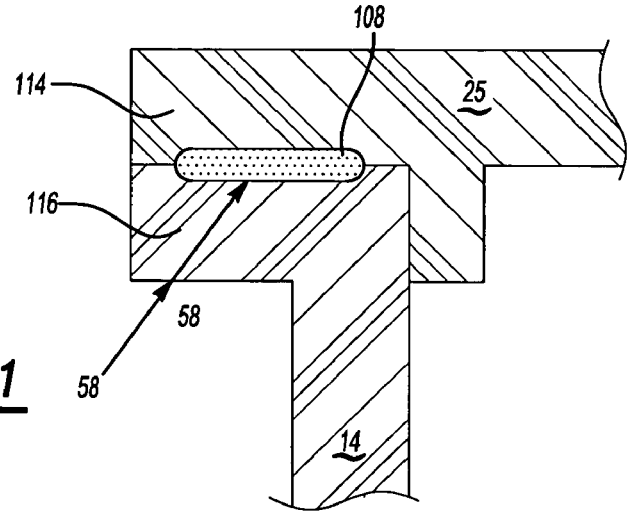
FIG. 11 is an enlarged cross-sectional view of an axial joint between the cover and the outer shell.
Figure 12:
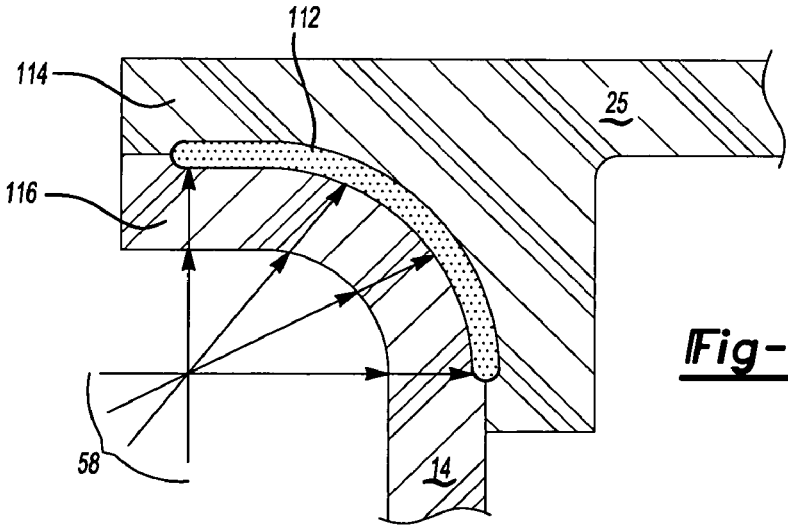
FIG. 12 is an enlarged cross-sectional view of a transitional joint between the cover and the outer shell.

Referring also to FIGS. 10–12, the cover 25 therefore includes an axial joint 108 portion and a radial joint portion 110 separated by a transitional joint 112 between the axial joint 108 and the radial joint 110. As the outer shell 14 is formed from a laser transmissive or transparent material, the cover 25 is fabricated from a laser absorbent material. The cover 25 includes a flange 114 at a top and bottom end that corresponds to a lip 116 provided on the outer shell 14. The laser device 40 directs laser energy 58 through the lip 116 of the outer shell 14 and into the flange 114 of the cover 25.

A middle portion 118 between the top and bottom axial joints 108 includes the radial joint 110 were the laser device 40 directs laser energy 58 normal to the surface of the outer shell 14. Laser energy 58 is transmitted through the outer shell 14 and into the sides of the cover 25 to form the radial joint 110. Between the axial joint 108 and the radial joint 110 is the transitional joint 112 were the interface between the cover 25 and the outer shell 14 curves from the flange 114 to the edge interface 120. The cover 25 is clamped and pressed onto the outer shell 14, and the different joint configurations reduces the effects on fit caused by the generous tolerances require by the injection molding process.

Figure 13:
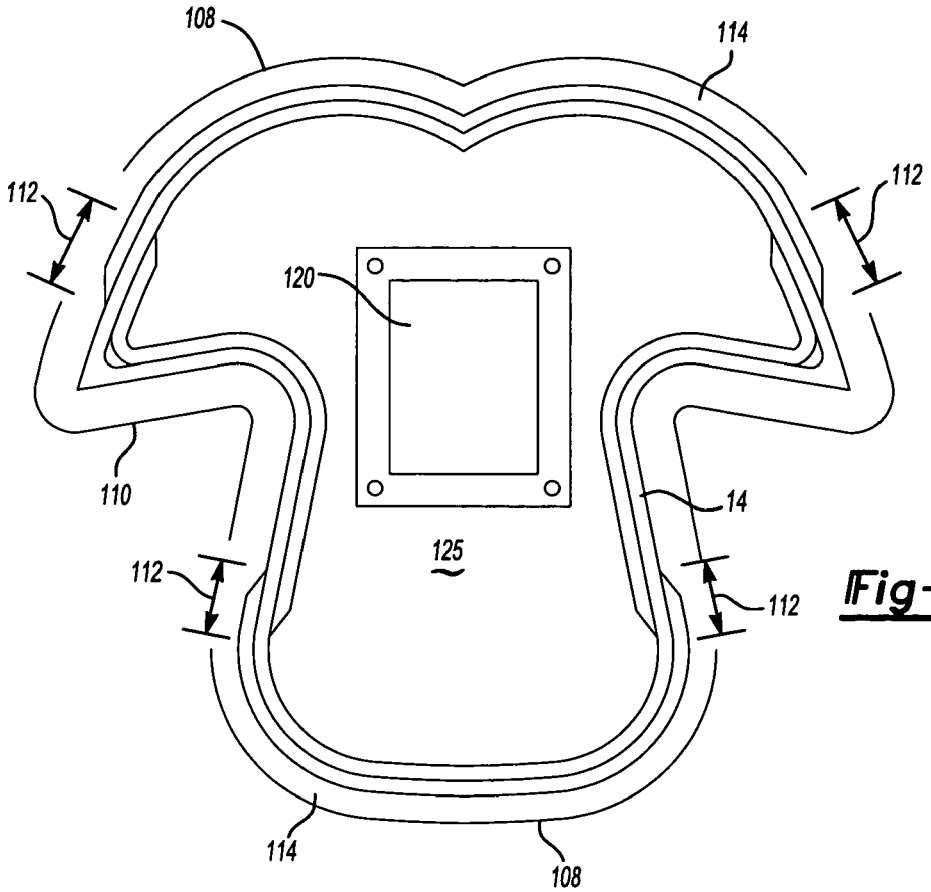
FIG. 13 is a plan view of a cover including a throttle body mount according to this invention.
Figure 14:
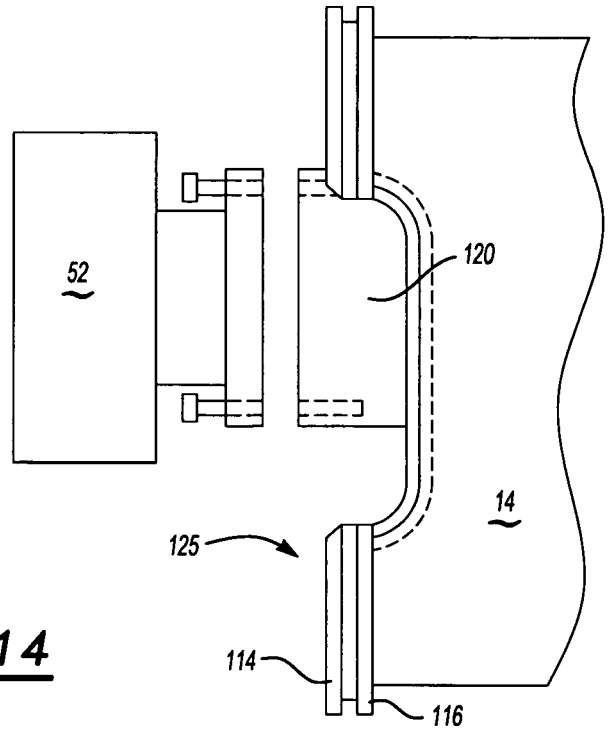
FIG. 14 is a side view of the cover illustrated in FIG. 13.

Referring to FIGS. 13 and 14, another example cover 125 according to this invention is shown that includes a mount 120 for a throttle body 52. The mount 120 defines an opening 122 for air to enter the intake manifold assembly 10. In some intake manifold applications it is desirable to install the throttle body 52 at the end of the manifold instead of at a top portion. The example cover 125 includes the mount 120 for the throttle body 52 and includes the several various joint features as described above with reference to FIGS. 10–12. The cover 125 is attached by a laser weld joint through the axial joint 108, transition joint 112 and radial joint 110. The mount 120 is included with the cover 125 to eliminate any additional components otherwise required to attach a throttle body to the intake manifold.

Figure 15:
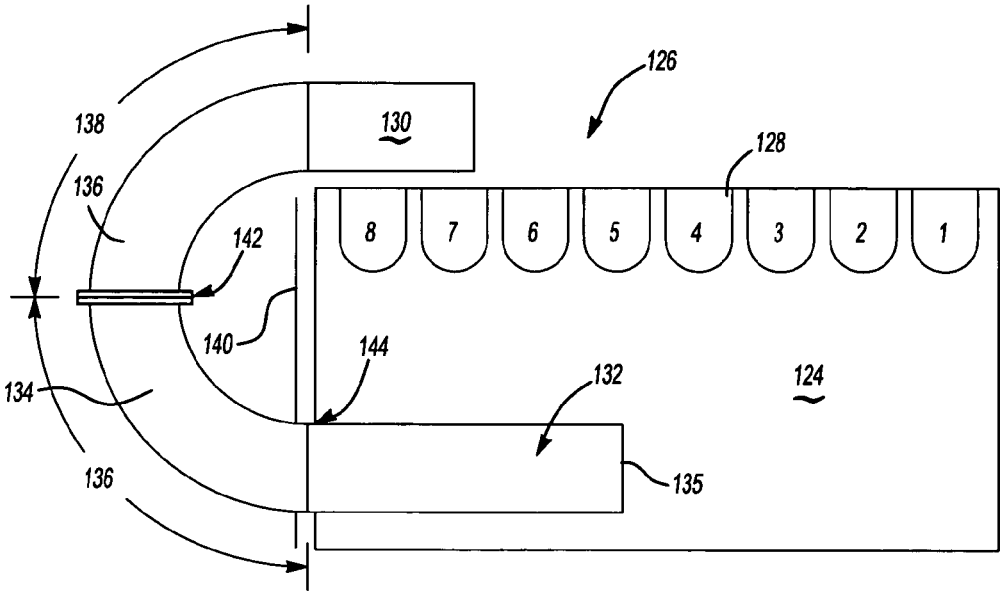
FIG. 15 is a schematic illustration of another throttle body mounting configuration according to this invention.

Referring to FIG. 15, another example manifold assembly 126 includes an extension tube 132 for extending an air inlet into the cavity 124. It is desirable that an air passage from the opening of the intake manifold into the engine be of a substantially equal length for each engine cylinder. Mounting of a throttle body at the cover does not provide this desired feature and therefore the tube 132 is provide to extend the opening into the cavity 124 inwardly to a substantially centrally located position. In the example intake manifold assembly 126 a throttle body 130 is mounted to a tube 136 above the intake manifold 126 with an opening 135 that extends around and through the cover 140 and into the cavity 124 of a outer shell 128. The tube 132 is attached to two curved sections 134, 136. The curved sections 134,136 provide a desired curve to traverse a desired angle 138. In the example shown each curved section 134, 136 provides approximately 80 degrees of curve that are joined by a laser welded joint 142 to provide the desired curve radius form the cover 140 to the throttle body 130. The tube 132 is attached to one of the curved sections 134 or the cover 140 at a laser weld joint 144. The throttle body 130 is disposed atop the outer shell 128 but at a slight upward angle relative to the outer shell 128. As appreciated, the specific angle and position of the throttle body 130 is application specific. The curves sections 134 and tube 132 can be modified to provide the desired position of the throttle body 130. Further, the length of the tube 132 can be adjusted to tune the intake manifold assembly 126 as desired.

Figure 16:
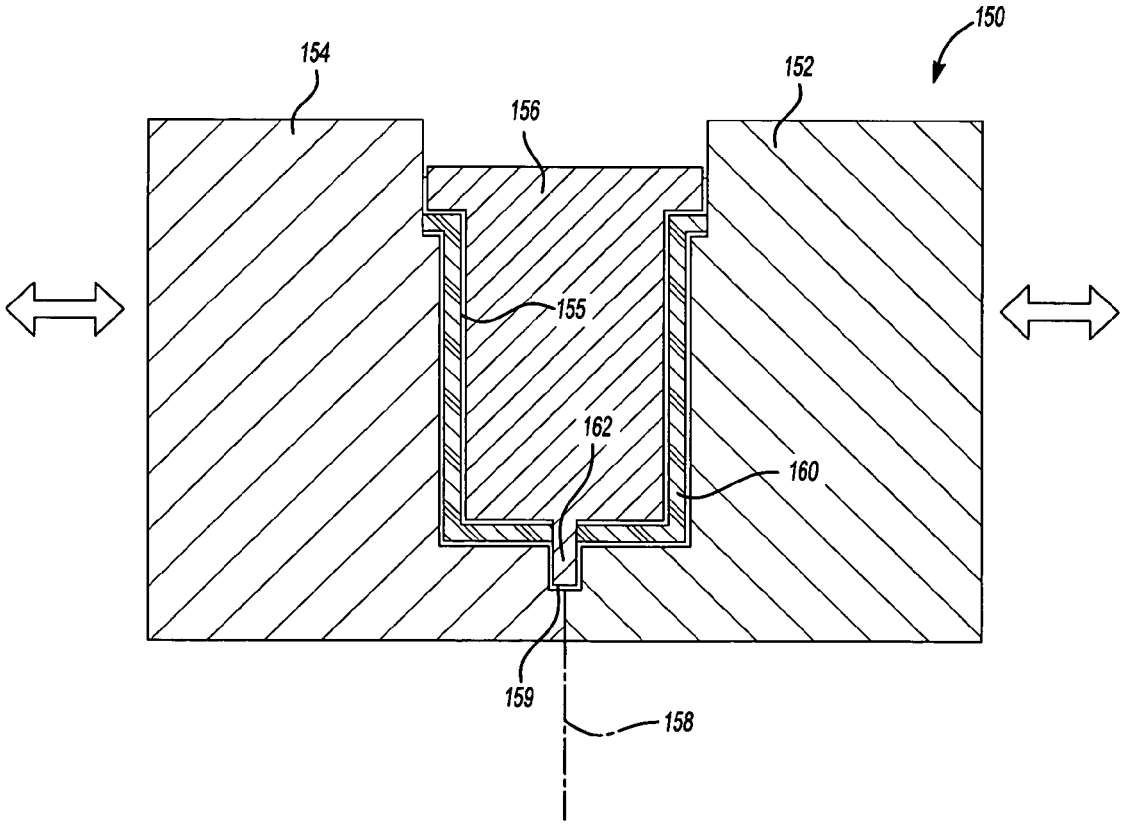
FIG. 16 is a schematic illustration of a molding machine tool for fabricating an outer shell according to this invention.

Referring to FIG. 16, a mold 150 for fabricating an outer shell 160 according to this invention is shown and includes a first half 152 and a second half 154. The first half 152 and the second half 154 are separate along the parting line 158. An insert 156 moves into a cavity 155 to complete the cavity for forming the outer shell 160. The insert 156 includes an alignment feature 162 to provide alignment of the completed outer shell 160 and the insert 156 within the cavity 155. The alignment feature 162 is a tab that fits within an opening 159 defined by the mold halves 152, 154. The alignment feature 162 maintains position of the insert 156 during the molding process to assure a consistent desired material thickness of the outer shell 160. The alignment feature 162 results in the formation of an opening 164 within the outer shell 160 that must be plugged to seal the manifold assembly.

Figure 17:
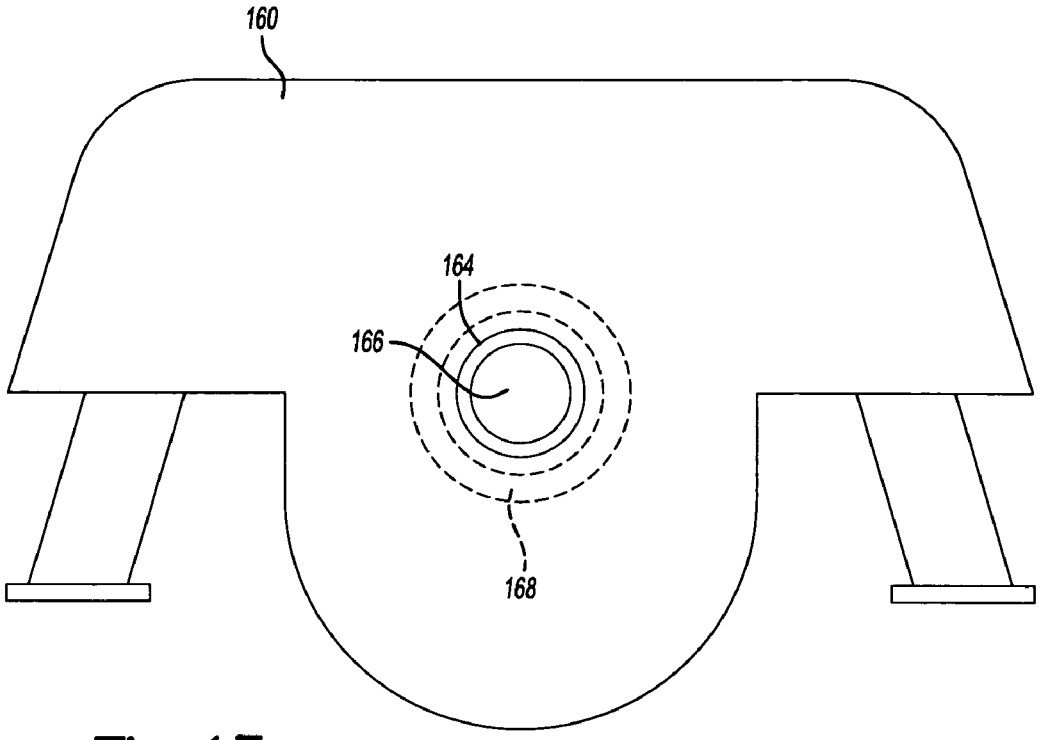
FIG. 17 is a plan view of an outer shell and inner shell interface according to this invention.
Figure 18:
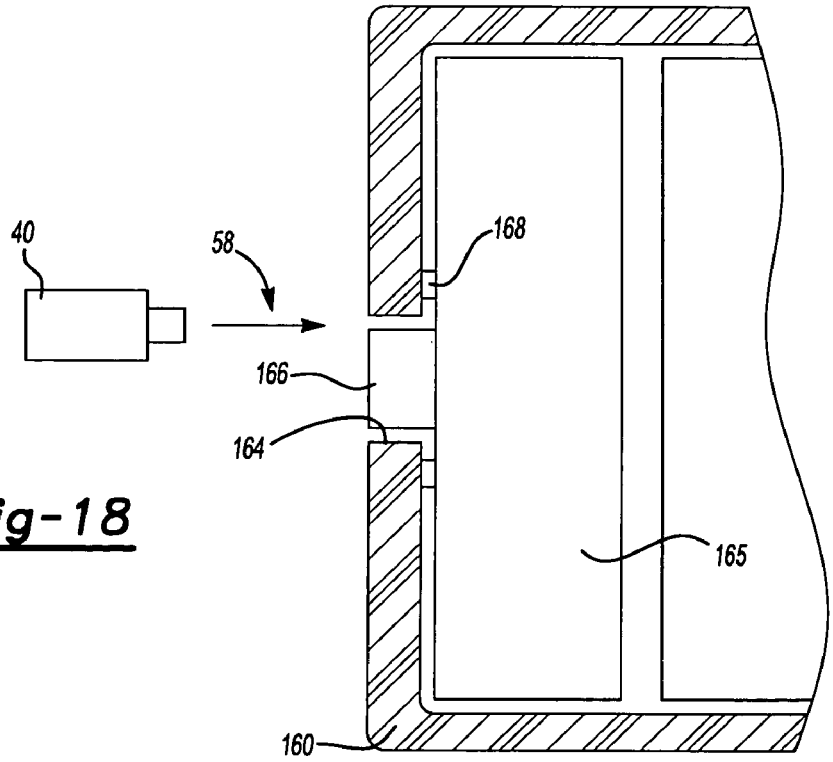
FIG. 18 is a side view of an outer shell and inner shell according to this invention.

Referring to FIGS. 17 and 18, the inner shell 165 includes a plug 166 that fits within the opening 164 of the outer shell 160. The inner shell 165 is inserted into the outer shell 160 such that a portion abuts an inner surface of the outer shell 160 adjacent the opening 164. A laser device 40 directs laser energy 58 to weld the inner shell 165 to the outer shell 160 adjacent the opening 160. The resulting laser weld joint 168 seals the manifold assembly. The plug 166 of the inner shell 165 not only provides the function of plugging the opening 164, but also provides an alignment function to properly align the inner shell 165 relative to the outer shell 160. This alignment function provides alignment at a substantially inaccessible location for the interface between the outer shell 160 and the inner shell 165 and therefore provides additional alignment that is not otherwise practical.

The example intake manifolds of this invention provide a substantial reduction in the number of parts, along with a substantial simplification in the joint between manifold parts. The example intake manifolds described include substantially two components, however, additional components as be required for a specific application would also benefit from the simplified joint configuration and laser weld process. Further, the example intake manifold substantially reduces assembly and manufacture time and expense.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. An intake manifold assembly comprising:

an outer shell having a first thickness and defining a cavity having an inner surface; and an inner shell comprising a plurality of dividers laser welded to said inner surface of said cavity for defining a plurality of air passages, wherein each of said plurality of dividers includes an edge portion having a first width for welding to said inner surface of said outer shell, said edge portion including at least one pad having a second width greater than said first width for increasing an area of a laser weld joint between said inner and outer shell at the at least one pad.

2. The assembly as recited in claim 1, including at least one of said pads in joint areas where a laser weld beam is disposed at an angle relative to the joint surface to provide an increased width for welding.

3. The assembly as recited in claim 1, wherein said outer shell includes a second thickness less than a first thickness that corresponds to desired weld points between said outer shell and said inner shell.

4. The assembly as recited in claim 1, wherein said outer shell includes a first end opening for receiving said inner shell and a second end opening distal from said first end opening for receiving a support tool.

5. The assembly as recited in claim 4, wherein said inner shell includes a plug portion received within said second end opening for sealing said second end opening.

6. The assembly as recited in claim 4, including a cover for sealing said first end opening, wherein said cover includes a radial joint and an axial joint with said outer shell.

7. The assembly as recited in claim 6, wherein said cover includes a transition joint that provides a joint between said axial and said radial joint such that a laser weld joint is disposed about an entire perimeter between said cover and said outer shell.

8. The assembly as recited in claim 4, including a throttle body mount plate for sealing said first end opening, said throttle body mount plate including a perimeter corresponding to a perimeter of said first end opening and a mount portion for receiving a throttle body device.

9. The assembly as recited in claim 8, including a center discharge tube attached to said throttle body mount plate extending into said cavity for providing a substantially similar airflow path for each divider.

10. The assembly as recited in claim 8, including a curved tube portion for mounting a throttle body remotely from said cover.

11. The assembly as recited in claim 10, wherein said curved tube portion comprises a first tube and a second tube each providing a portion of a total arc for said curved tube portion for positioning a throttle body in a desired location relative to said intake manifold assembly.

12. The assembly as recited in claim 1, wherein said inner shell is formed from a plastic material having less than 15% glass reinforcing material.

13. The assembly as recited in claim 1, wherein said inner shell is formed from a plastic material void of any glass reinforcing material.

14. The assembly as recited in claim 1, wherein one of said inner shell and said Outer shell is formed from a material including a foaming agent, said foaming agent providing an out-gassing upon exposure to heat for increasing a quantity of molten material upon exposure to heat.

15. The assembly as recited in claim 1, including a torque ridge within said cavity and a torque pad disposed on said inner shell such that an assembly tool is engageable with said torque ridge and said torque pad for clamping said inner shell against said inner surface of said outer shell.

16. The assembly as recited in claim 15, wherein said assembly tool comprises a flat portion insertable between said torque ridge and said torque pad, said assembly tool rotatable against said torque pad and held in place by said torque ridge for applying a force on said inner shell that causes abutment between said inner shell and said outer shell.

17. A method of fabricating an intake manifold assembly comprising the steps of:

a. aligning an insert within a mold for defining a cavity for forming an outer shell;

b. forming a first opening within the outer shell for inserting an inner shell, and a second opening within the outer shell with an alignment feature of the insert;

c. forming a plug portion on the inner shell that corresponds to the second opening within the outer shell;

d. inserting the inner shell into a cavity defined by the outer shell such that the plug portion is received within the second opening; and e. laser welding the inner shell to an inner surface of the outer shell.

18. The method as recited in claim 17, including the step of clamping the inner shell to an inner surface of the outer shell for reducing a gap between the outer shell and the inner shell.

19. The method as recited in claim 18, wherein the outer shell includes a torque ridge and the inner shell includes a torque pad, and the clamping step comprises inserting an assembly tool between the torque ridge and the toque pad and applying a load forcing the inner shell into contact with the inner surface of the outer shell.

20. The method as recited in claim 19, wherein said clamping step includes rotating the assembly tool to apply the load forcing the inner shell into contact with the inner surface of the outer shell.

21. The method as recited in claim 18, wherein said clamping step includes inserting a housing including a plurality of pistons actuatable to force the inner shell against the inner surface of the outer shell, and actuating the plurality of pistons to clamp the inner shell against the outer shell.

22. The method as recited in claim 21, wherein the inner shell includes a plurality of dividers having an a peripheral edge surface with a portion the edge surface include pad portions having a greater width than other portions of the edge surface.

23. The method as recited in claim 22, wherein the outer shell includes a first thickness and a second thickness less than said first thickness, wherein said second thickness is disposed in a weld area and said step e) further comprises directing laser energy along the weld area having the second thickness.

24. A method of fixturing plastic intake manifold components for welding, said method comprising the steps of:

a) inserting an assembly tool between an inner shell disposed within an outer shell;

b) forming a pad on the inner shell for contacting the assembly tool; and c) rotating the assembly tool and biasing the inner shell against an inner surface of the outer shell.

25. The method as recited in claim 24, including the step of forming a ridge within the outer shell for supporting rotation of the assembly tool and biasing of the inner shell against the inner surface of the outer shell.

26. The method as recited in claim 24, wherein the assembly tool comprises a blade that extends longitudinally between the inner shell and the outer shell.

* * * * *